US007488278B2

(12) United States Patent
Zhang

(10) Patent No.: US 7,488,278 B2
(45) Date of Patent: Feb. 10, 2009

(54) EXERCISE FURNITURE

(76) Inventor: Qi Zhang, 1303 Avocado Ave., Suite 110, Newport Beach, CA (US) 92660

( * ) Notice: Subject to any disclaimer, the term of this patent is extended or adjusted under 35 U.S.C. 154(b) by 44 days.

(21) Appl. No.: 11/645,906

(22) Filed: Dec. 26, 2006

(65) Prior Publication Data

US 2007/0149372 A1 Jun. 28, 2007

Related U.S. Application Data

(60) Provisional application No. 60/754,822, filed on Dec. 28, 2005.

(51) Int. Cl.

| | |
|---|---|
| ***A63B 21/00*** | (2006.01) |
| ***A63B 21/068*** | (2006.01) |
| ***A63B 26/00*** | (2006.01) |
| ***A47C 3/02*** | (2006.01) |

(52) U.S. Cl. ..... 482/123; 482/92; 482/95; 482/133; 482/142; 297/258.1

(58) Field of Classification Search ..... 482/8, 482/91, 140, 142, 148; 297/423.26, 259.1, 297/260.1, 423.1, 423.19, 423.25, 423.3, 297/258.1, 271.6

See application file for complete search history.

(56) References Cited

U.S. PATENT DOCUMENTS

| | | | | |
|---|---|---|---|---|
| 4,707,025 | A * | 11/1987 | Rogers, Jr. | 297/259.2 |
| 6,132,342 | A * | 10/2000 | McKinney et al. | 482/93 |
| 2003/0171189 | A1* | 9/2003 | Kaufman | 482/8 |
| 2005/0181916 | A1* | 8/2005 | Frost et al. | 482/140 |
| 2006/0035769 | A1* | 2/2006 | Phillips | 482/123 |

* cited by examiner

*Primary Examiner*—Loan H Thanh
*Assistant Examiner*—Zackary Schoemer
(74) *Attorney, Agent, or Firm*—Raymond Y. Chan; David and Raymond Patent Firm

(57) ABSTRACT

A kind of exercise furniture includes a rocking frame and a recliner frame. The rocking frame has a rocking base. The recliner frame, which is supported by the rocking frame, includes a back support and a seat support mounted to the back support to define a recliner angle therebetween, wherein the recliner frame is adapted for primarily exercising a user's abdomen when the back support and the seat support are pivotally and repeatedly folded with the leg support to alter its inclined angle, so as to concurrently generate a rocking motion at the rocking base of the rocking frame.

4 Claims, 3 Drawing Sheets

EXERCISE FURNITURE

CROSS REFERENCE OF RELATED APPLICATION

This is a regular application of a provisional application, application No. 60/754,822, filed Dec. 28, 2005.

BACKGROUND OF THE PRESENT INVENTION

1. Field of Invention

The present invention relates to furniture, and more particularly to exercise furniture which is capable of being rocked in repetitive manner for exercising a user's abdomen and enhancing blood circulation.

2. Description of Related Arts

A conventional recliner usually comprises a main frame and a supporting seat mounted on the main frame for a user to seat thereon. The main frame comprises two rocking leg frames each having a curved bottom surface for guiding a rocking movement of the recliner. When the user is seating on the recliner, he or she is adapted to exert a slight rocking force towards the main frame for generating a rocking movement of the recliner. This rocking movement usually imparts the user with a unique comfort when sitting on the recliner.

A major disadvantage of this kind of recliner is that it is sometimes regarded as luxury since recliners do not provide other functions except the provision of rocking movement. However, it cannot simply substitute conventional chairs because the leg frames of a recliner are different from that of a conventional chair. Since almost all recliners are bulky in size, many people think that they occupy too much space in their home with no significant practical use.

On the other hand, many people would like to install some forms of exercise equipments in their home so that they may exercise at home whenever they have time. As a result, they do not have to rely on fitness centers and may save considerable amount of money which should have been paid to those fitness centers as membership fees.

A major disadvantage for this practice is that the exercise equipments are usually bulky in size and do not serve other functions. As a result, they are usually installed in a specific room separated from other parts of the user's house or apartment so that the user may do nothing else but exercise. This creates an extremely inflexible use of the user's home resources.

SUMMARY OF THE PRESENT INVENTION

A main object of the present invention is to provide a kind of exercise furniture which is capable of being rocked in repetitive manner for exercising a user's abdomen and enhancing users' blood circulation.

Another object of the present invention is to provide a kind of exercise furniture which simultaneously allows the user to rock thereon and to exercise his or her abdomen while generating the rocking movement.

Another object of the present invention is to provide a kind of exercise furniture which concurrently allows the user to exercise in a convenient manner, and generates a rocking movement while the user is exercising. In other words, the present invention removes the inflexibility of conventional recliners and exercise equipments as mentioned above.

Another object of the present invention is to provide a kind of exercise furniture which is capable of fitting into one's domestic environment so as to avoid unnecessary occupation of the user's home space.

Another object of the present invention is to provide a kind of exercise furniture which does not involve complicated mechanical component so as to minimize the manufacturing cost as well as the ultimate selling price of the present invention. In other words, the present invention is value-for-money and optimal for widespread use.

Accordingly, in order to accomplish the above objects, the present invention provides an exercise furniture, comprising:

a rocking frame having a rocking base, and a recliner frame, which is supported by the rocking frame, comprising a back support and a seat support mounted to the back support to define a recliner angle therebetween, wherein the recliner frame is adapted for primarily exercising a user's abdomen when the back support is pivotally and repeatedly folded with the seat support to alter the recliner angle, so as to concurrently generate a rocking motion at the rocking base of the rocking frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
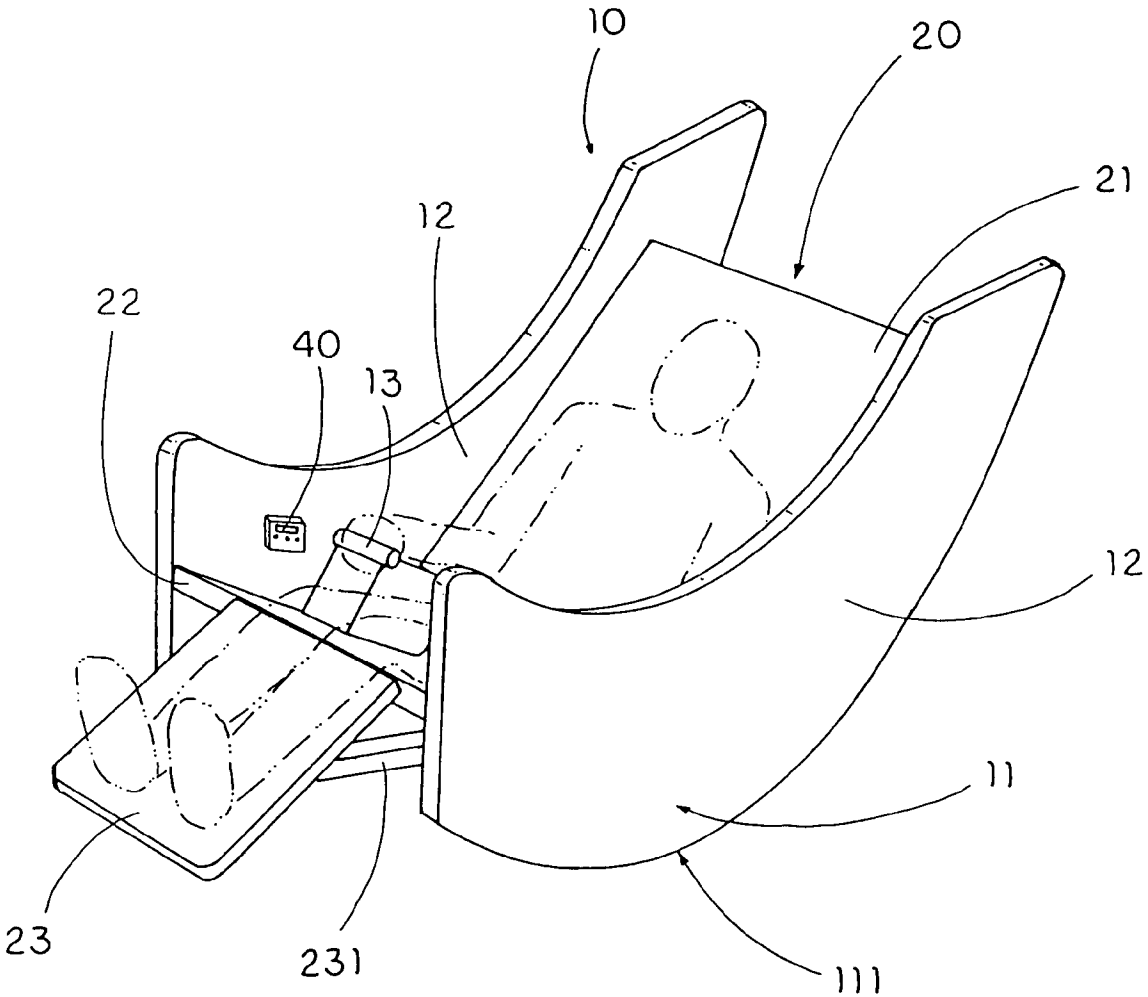
FIG. 1 is a perspective view of exercise furniture according to a preferred embodiment of the present invention.
Figure 2:
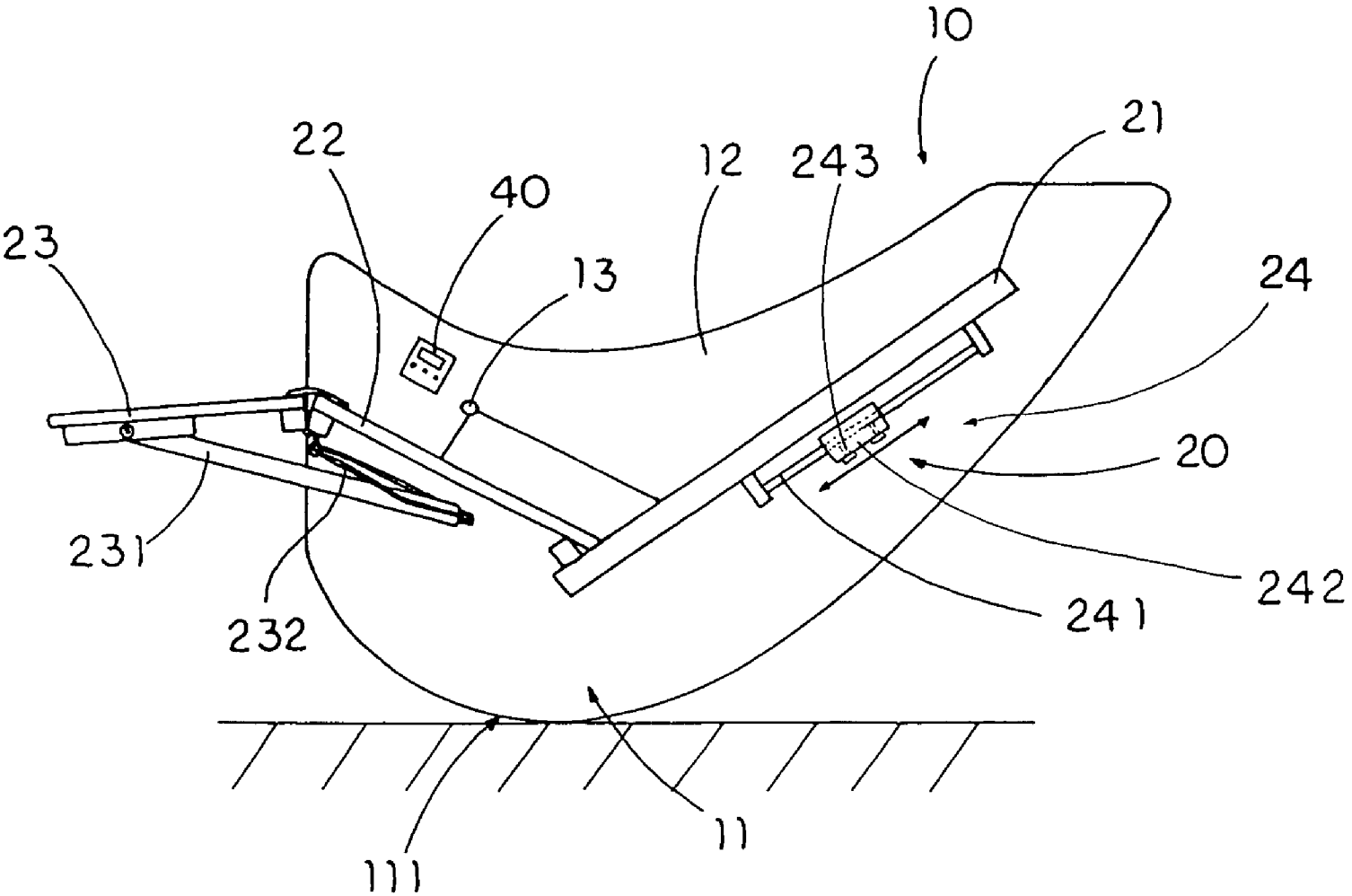
FIG. 2 is a sectional side view of the exercise furniture according to the above preferred embodiment of the present invention.
Figure 3:
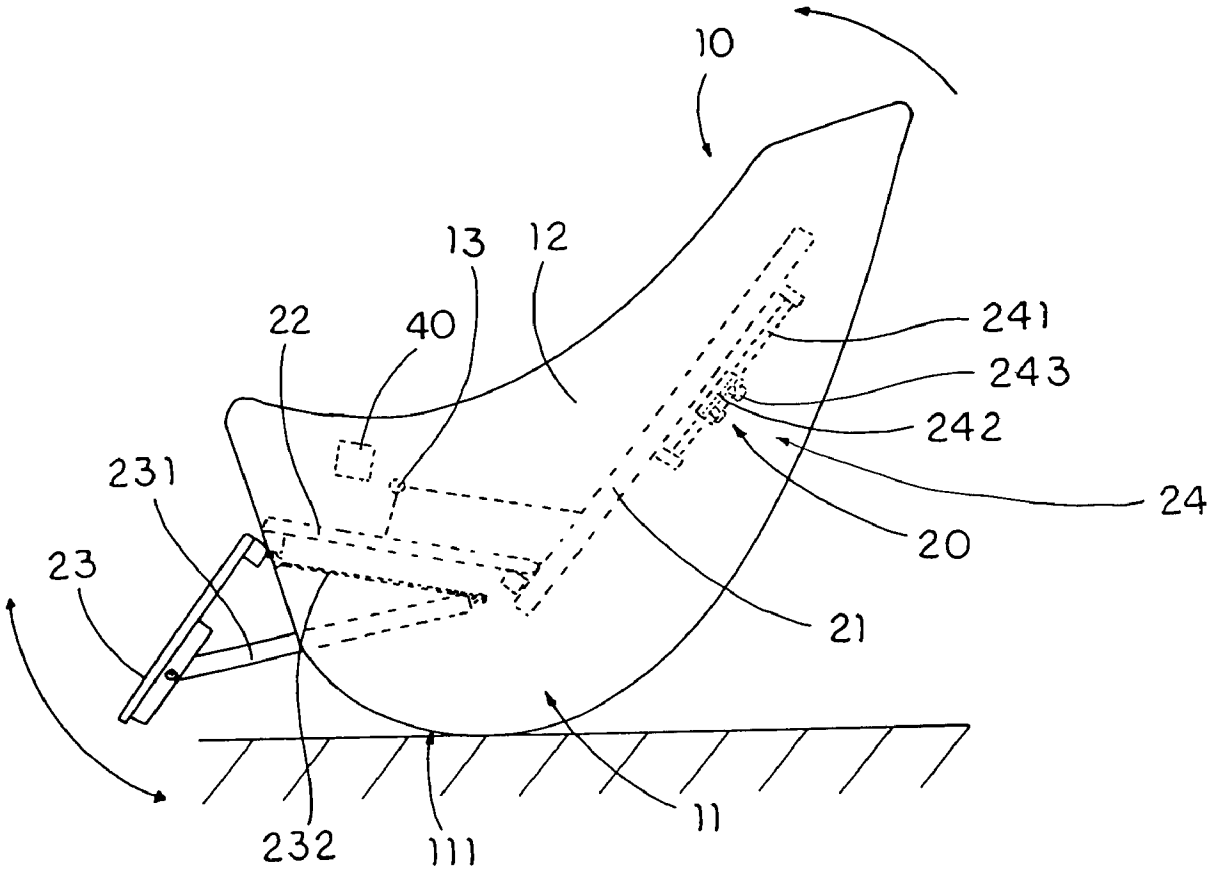
FIG. 3 is a side view of the exercise furniture according to the above preferred embodiment of the present invention.

Referring to FIG. 1 to FIG. 3 of the drawings, a kind of exercise furniture according to a preferred embodiment of the present invention is illustrated, in which the exercise furniture comprises a rocking frame 10 having a rocking base 11, and a recliner frame 20.

According to the preferred embodiment of the present invention, the recliner frame 20, which is supported by the rocking frame 10, comprises a back support 21, a seat support 22 and a leg support 23 pivotally mounted to the seat support 22, wherein the recliner frame 20 is adapted for primarily exercising a user's abdomen when the leg support 23 is pivotally and repeatedly folded with the seat support 23, so as to concurrently generate a rocking motion at the rocking base 11 of the rocking frame 10.

The rocking frame 10 comprises two supporting members 12 supporting the recliner frame 20 therebetween, wherein the rocking base 11 is formed at two bottom portions of each of the supporting members 12 for providing a rocking surface 111 to guide the rocking movement of the exercise furniture. Referring to FIG. 1 of the drawings, each of the rocking surfaces 111 has a predetermined radius of curvature so that the supporting members 12 are capable of rocking alone the two rocking surfaces 111 respectively. In other words, the rocking surfaces 111 dictate the extent to which the rocking frame 10 can be rocked for exercising the user's abdomen and his or her legs.

On the other hand, the recliner frame 20 further comprises an exercise arrangement 24 mounted on the rocking frame 10 for providing an optimal loading thereon for the user to exercise his or her abdomen and the legs. More specifically, the exercise arrangement 24 comprises a mounting device 241 provided on a rear side of the back support 21, and a weight 242 adjustably mounted on the mounting device 241 for providing an optimal loading to the back support 21 so that the user is arranged to exercise in a corresponding rigor for initiating the rocking movement of the rocking frame 10.

The mounting device 241 is preferably embodied as a guiding track wherein the weight 242 is arranged to slide along the guiding track for retaining at a predetermined position thereon. Since a center of gravity of the rocking frame 10 and the recliner frame 20 will be varied when the position of the weight varies along the guiding track, therefore the user has to exert differing amount of rocking force to initiate the rocking movement of the rocking frame 10. According to simple mechanics, for a given weight 242, the farther the distance between the weight 242 and the seat support 22, the more force the user has to exert to the back support 21 for initiating the rocking movement. The exercise arrangement 24 further comprises a weight adjuster 243 mounted at the mounting device 241 for selectively locking a position of the weight 242 so as to allow selective adjustment of an optimal loading (as provided by the weight 242) against which the user exercises. The weight adjuster 243 can be embodied as a screwing assembly provided at the mounting device 241 for selectively locking a position of the weight 242 with respect to the mounting device 241.

On the other hand, the recliner frame 20 further comprises a resilient exercise arrangement mounted on the rocking frame 10 for normally retaining a predetermined angle between the seat support 22 and the leg support 23, wherein the resilient exercise arrangement comprises a connecting member 231 having one end connecting with the seat support 22, and another end pivotally connected with the leg support 23 for pivotally folding the leg support 23 with respect to the seat support 22 so as to allow exercising the user's abdomen while initiating the rocking movement of the rocking frame 10 and the recliner frame 20.

Moreover, the resilient exercise arrangement further comprises a resilient member 232 mounted on the recliner frame 20 for normally exerting an urging force towards the connecting member 231 so as to normally retain the seat support 22 and the leg support 23 in position at the inclined angle. In other words, the legs support 23 is adapted to be pivotally folded with respective to the seat support 22 for initiating the rocking movement of the rocking frame 10 while the resilient element 232 restores the leg support 23 and the seat support 22 at the original inclined angle.

Consequently, the user is able to exercise his leg portion by exerting a downward pivotal force towards the legs support 23 for pivotally folding the legs support 23 towards the seat support 22 so as to increase the inclined angle between the seat support 22 and the legs support 23. In other words, the user of the present invention has to exert a force for overcoming the urging force of the resilient element 232 so as to pivotally fold the legs support 23 with respect to the seat support 22 for increasing the inclined angle. The back support 21, the seat support 22 and the legs support 23 are adapted for being laid by the user so that he or she has to exercise his abdomen and legs in order to exert the force to pivotally fold the legs support 23 while generating the recurrent rocking movement.

According to the preferred embodiment of the present invention, it is worth mentioning that the recliner angle between the back support 21 and the seat support 22 is pre-adjustable so that the user may, according to his or her body weight and height, choose an optimal recliner angle for exercising his or her abdomen and legs.

The operation of the present invention is as follows: when the user wishes to exercise with the exercise furniture, he or she needs to sit on the seat support 22 while resting his back portion and legs on the back support 21 and the legs support 23 respectively. As such, the user is able to exercise his or her abdomen by initiating the rocking movement which is guided by the rocking base 11 of the rocking frame 10. Moreover, the user can fold his or her legs by exerting an urging force to pivotally fold the legs support 23 towards the seat support 22. As a result, the user is capable of exercising while enjoying the rocking movement of the exercise furniture. It is important to point out that the present invention is not meant to facilitate rigorous exercise so that the exercise furniture is optimal for domestic use by a wide range of users, such as the elderly, children, and those who wish to exercise abdomen and/or the legs.

In order to further enhance the functions of the present invention, the exercise furniture further comprises a control timer 40 provided on the recliner frame 20 for indicating time or health information relating to the exercise. For example, the control timer 40 may indicate how long the user has been exercising and how much calories the user has been using during exercise. Moreover, the control timer 40 may have a programmable alarm device for setting a predetermined time of exercise. When the time is up, a sound signal may be generated to signal the user that his or her exercise period should be over.

Besides, the exercise furniture may further comprise a massage device provided on the back support 21, and adapted to perform predetermined massage to the user's neck or head portion.

It is worth mentioning that the rocking frame 10 further comprises two handles 13 provided on inner sides of the supporting members 12 respectively and aligned with the hands portion of the user's body for allowing the user to conveniently hold on the handles 13 so as to provide support for the user when he or she is exercising.

From the forgoing descriptions, it can be shown that the above-mentioned objects have been substantially accomplished. The present invention provides a kind of exercise furniture which allows the user to initiate a rocking movement while at the same time exercising his or her abdomen and the legs.

Thus, the main purpose of this invention is to relax the user's body and release his or her stress by changing the user's body position. The present invention makes the user's body swinging back and forth, thereby enhancing blood circulation.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. Exercise furniture, comprising:

a rocking frame having a rocking base;

a recliner frame, which is supported by the rocking frame, comprising:

a back support, a seat support, a leg support pivotally mounted to said seat support, wherein said recliner frame is adapted for primarily exercising a user's abdomen when said leg support is pivotally and repeatedly swung about said seat support, so as to concurrently generate a rocking motion at said rocking base of said rocking frame, an exercise arrangement mounted on said rocking frame for providing an optimal loading thereon for said user to exercise, wherein said exercise arrangement comprises a mounting device provided on a rear side of said back support and a weight adjustably mounted on said mounting device for providing an optimal loading to said back support so that said user is arranged to exercise in a corresponding rigor for initiating said rocking movement of said rocking frame, wherein said mounting device comprises a guiding track and said weight is arranged to slide along said guiding track for retaining at a predetermined position thereon, such that said user is allowed to selectively adjust an optimal loading against which said user exercises for achieving an optimal exercise performance, and a resilient exercise arrangement mounted on said rocking frame for normally retaining a predetermined angle between said seat support and said leg support, wherein said resilient exercise arrangement comprises a connecting member having one end connecting with said seat support and another end pivotally connected with said leg support for pivotally folding said leg support with respect to said seat support so as to allow exercising said user's body while initiating said rocking movement of said rocking frame and said recliner frame, wherein said resilient exercise arrangement further comprises a resilient member mounted on said recliner frame for normally exerting an urging force towards said connecting member so as to normally retain said seat support and said leg support in position at said inclined angle; and a control timer having a programmable alarm provided on said recliner frame for indicating time and health information relating to said exercise of said user's body.

2. The exercise furniture, as recited in claim 1, wherein said rocking frame further comprises two handles provided on inner sides of said supporting members respectively and aligned with arms portion of said user's body for allowing said user to conveniently grip on said handles to provide support for said user when said user is exercising.

3. Exercise furniture, comprising:

a rocking frame comprising two supporting members and a rocking base formed at two bottom portions of each of said supporting members for providing a rocking surface to guide said rocking movement of said exercise furniture when said exercise furniture is swung about said rocking surface, wherein each of said rocking surfaces has a predetermined radius of curvature for dictating an extent to which said rocking frame is capable of being rocked for exercising said user's body;

a recliner frame, which is supported between said two supporting members of said rocking frame, comprising:

a back support, a seat support, a leg support pivotally mounted to said seat support, wherein said recliner frame is adapted for primarily exercising a user's abdomen when said leg support is pivotally and repeatedly swung about said seat support, so as to concurrently generate a rocking motion at said rocking base of said rocking frame, an exercise arrangement mounted on said rocking frame for providing an optimal loading thereon for said user to exercise, wherein said exercise arrangement comprises a mounting device provided on a rear side of said back support and a weight adjustably mounted on said mounting device for providing an optimal loading to said back support so that said user is arranged to exercise in a corresponding rigor for initiating said rocking movement of said rocking frame, wherein said mounting device comprises a guiding track and said weight is arranged to slide along said guiding track for retaining at a predetermined position thereon, such that said user is allowed to selectively adjust an optimal loading against which said user exercises for achieving an optimal exercise performance, and a resilient exercise arrangement mounted on said rocking frame for normally retaining a predetermined angle between said seat support and said leg support, wherein said resilient exercise arrangement comprises a connecting member having one end connecting with said seat support and another end pivotally connected with said leg support for pivotally folding said leg support with respect to said seat support so as to allow exercising said user's body while initiating said rocking movement of said rocking frame and said recliner frame, wherein said resilient exercise arrangement further comprises a resilient member mounted on said recliner frame for normally exerting an urging force towards said connecting member so as to normally retain said seat support and said leg support in position at said inclined angle; and a control timer having a programmable alarm provided on said recliner frame for indicating time and health information relating to said exercise of said user's body.

4. The exercise furniture, as recited in claim 3, wherein said rocking frame further comprises two handles provided on inner sides of said supporting members respectively and aligned with arms portion of said user's body for allowing said user to conveniently grip on said handles to provide support for said user when said user is exercising.

* * * * *